US010787763B2

(12) United States Patent
Zhang et al.

(10) Patent No.: US 10,787,763 B2
(45) Date of Patent: Sep. 29, 2020

(54) WASHING MACHINE AND OUTER DRUM THEREOF

(71) Applicant: Qingdao Haier Drum Washing Machine Co., Ltd., Shandong (CN)

(72) Inventors: Huacheng Zhang, Shandong (CN); Zongyuan Weng, Shandong (CN); Qidui Liang, Shandong (CN); Zhiqiang Zhang, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 232 days.

(21) Appl. No.: 15/577,534

(22) PCT Filed: May 27, 2016

(86) PCT No.: PCT/CN2016/083712
§ 371 (c)(1),
(2) Date: Nov. 28, 2017

(87) PCT Pub. No.: WO2016/192593
PCT Pub. Date: Dec. 8, 2016

(65) Prior Publication Data

US 2018/0135230 A1 May 17, 2018

(30) Foreign Application Priority Data

May 29, 2015 (CN) ..... 2015 1 0289879

(51) Int. Cl.
*D06F 39/12* (2006.01)
*D06F 37/26* (2006.01)
(Continued)

(52) U.S. Cl.
CPC ..... *D06F 39/12* (2013.01); *D06F 37/26* (2013.01); *D06F 37/264* (2013.01); *D06F 37/42* (2013.01); *D06F 39/001* (2013.01)

(58) Field of Classification Search
CPC ..... D06F 37/26; D06F 37/264; D06F 39/12
See application file for complete search history.

(56) References Cited

U.S. PATENT DOCUMENTS 3,436,934 A * 4/1969 Stilwell, Jr. ..... D06F 23/025 68/140
4,423,607 A * 1/1984 Munini ..... D06F 37/265 68/23.2

(Continued)

FOREIGN PATENT DOCUMENTS

CN 2414086 Y * 1/2001
CN 1814899 A 8/2006

(Continued)

OTHER PUBLICATIONS

Machine translation of WO-2008107022-A1, dated Sep. 2008. (Year: 2008).*

(Continued)

*Primary Examiner* — Joseph L. Perrin
*Assistant Examiner* — Kevin G Lee
(74) *Attorney, Agent, or Firm* — Burns & Levinson, LLP; Joseph M. Maraia

(57) ABSTRACT

An outer drum of a washing machine is provided, and relates to the technical field of washing machines. Two opposite side walls of the outer drum of the washing machine are formed as non-circular surfaces to avoid collision with side plates of a housing. A washing machine having the above outer drum is further provided.

7 Claims, 8 Drawing Sheets

(51) Int. Cl.
*D06F 37/42* (2006.01)
*D06F 39/00* (2020.01)

(56) References Cited

U.S. PATENT DOCUMENTS

| | | | | |
|---|---|---|---|---|
| 8,651,122 | B2 | 2/2014 | Haltmayer et al. | |
| 2009/0314315 | A1 | 12/2009 | Haltmayer et al. | |
| 2011/0146357 | A1* | 6/2011 | Arzate Silva | D06F 37/26 68/212 |
| 2011/0265525 | A1 | 11/2011 | Gweon | |
| 2012/0055208 | A1* | 3/2012 | Kwon | D06F 37/22 68/140 |
| 2012/0060567 | A1 | 3/2012 | Kwon et al. | |
| 2013/0145799 | A1 | 6/2013 | Lee et al. | |
| 2014/0033772 | A1* | 2/2014 | Jung | D06F 37/145 68/131 |

FOREIGN PATENT DOCUMENTS

| | | | | |
|---|---|---|---|---|
| CN | 201972014 | U | 9/2011 | |
| CN | 102782200 | A | 11/2012 | |
| CN | 103161048 | A | 6/2013 | |
| CN | 203334037 | U | 12/2013 | |
| CN | 103572554 | A | 2/2014 | |
| DE | 3119106 | A1 | 12/1982 | |
| EP | 2602376 | A2 | 6/2013 | |
| EP | 2631343 | A1 | 8/2013 | |
| JP | 2013118877 | A | 6/2013 | |
| KR | 101162202 | B1 | 7/2012 | |
| KR | 10-2013-0065208 | A | 6/2013 | |
| WO | WO-2008107022 | A1 * | 9/2008 | D06F 37/267 |

OTHER PUBLICATIONS

European Search Report dated Nov. 6, 2018, for Application No. 16802516.1.

* cited by examiner

WASHING MACHINE AND OUTER DRUM THEREOF

CROSS REFERENCE TO RELATED APPLICATIONS

This application is the U.S. national phase entry under 35 U.S.C. § 371 of International Application No. PCT/CN2016/083712, filed May 27, 2016, entitled WASHING MACHINE OUTER BARREL AND WASHING MACHINE, which claims priority to Chinese Patent Application No. 201510289879.0, filed May 29, 2015, the contents of which are incorporated herein by reference in their entirety for all purposes.

TECHNICAL FIELD

The present disclosure relates to the technical field of washing machines, and for example, relates to a washing machine and an outer drum thereof.

BACKGROUND

As shown in FIG. 1, an outer drum 1' of a washing machine is generally circular in appearance. The outer drum 1' is generally suspended on both sides of a housing 3' of the washing machine by hanging springs 2' on both sides above a drum body of the outer drum, and is supported by two shock absorbers 4' below the drum body of the outer drum so as to reduce a vibration amplitude and jointly stabilize the drum body of the outer drum 1'. The outer drum limits a diameter of an inner drum without increasing the diameter of the outer drum, causing a limitation to a washing capacity of the washing machine. When the diameter of the outer drum is increased without changing a structure and a size of the housing, a space between the housing and the outer drum may be reduced, and the drum may collide with the housing and cause deformation of the housing and other problems during operation. Thus, when a space of the housing of the washing machine is fixed, in order to prevent the outer drum from colliding and interfering with two side plates of the housing in an operation process of the washing machine, a certain space must be kept between the drum body of the outer drum and the housing. A measure generally taken in a relevant technology is to reduce the diameter of the outer drum, which may reduce the capacity of the inner drum, thereby restricting increase of the washing capacity of the washing machine.

Based on the above description, a novel outer drum of the washing machine is required to solve the problem that the outer drum collides with the housing and causes the deformation of the housing during operation since the diameter of the outer drum is increased when the space of the housing of the washing machine is fixed, or to avoid the problem that the washing capacity of the washing machine is reduced because the diameter of the outer drum is reduced to prevent the outer drum from colliding with the housing in the operation process of the washing machine.

SUMMARY

The present disclosure proposes an outer drum of a washing machine. According to the outer drum, an internal space of the washing machine is sufficiently used, a diameter and washing capacity of the washing machine are increased, and a problem that the outer drum collides and interferes with a housing in an operation process of the washing machine is effectively avoided, without changing the housing of the washing machine.

The present disclosure adopts the following embodiments to implement the outer drum.

The present disclosure provides an outer drum of a washing machine. Two opposite side walls of the outer drum are formed as non-circular surfaces to avoid collision with side plates of the housing.

As an alternative embodiment of the outer drum of the washing machine, the non-circular surfaces are flat surfaces or curved surfaces formed by splicing arc curved surfaces with different curvatures.

As an alternative embodiment of the outer drum of the washing machine, reticular reinforcing ribs are arranged on an outer side wall and an outer bottom wall of the outer drum. Such structure of reticular reinforcing ribs can improve overall strength of the outer drum and save manufacturing raw materials while saving raw materials without increasing a wall thickness of the outer drum.

As an alternative embodiment of the outer drum of the washing machine, an inner bottom wall of the outer drum is a smooth arc surface matched with a rear flange of an inner drum in shape. Such smooth arc surface can reduce attachment of dirt in a drum body of the outer drum, and also can reasonably save an assembling space to increase a volume of the inner drum.

As an alternative embodiment of the outer drum of the washing machine, at least two positioning holes are formed on an outer circumferential surface of the outer drum. Axis directions of the positioning holes are the same as that of the outer drum. Each of the positioning holes is penetrated by a positioning support rod so that the outer drum is fixed to the housing by the positioning support rod. The outer drum of the washing machine adopts a transporting and fixing apparatus with an above structure to support and fix the drum body during transportation, so as to limit up-and-down displacement of the drum body of the outer drum, effectively improve a package transporting and assembling structure of the outer drum, and improve safety and reliability of transportation and assembly.

As an alternative embodiment of the outer drum of the washing machine, a plurality of reinforcing ribs are arranged on the outer circumferential surface of the outer drum. Each of the reinforcing ribs is arranged around the positioning hole corresponding to the reinforcing rib. A total number of the reinforcing ribs is matched with a total number of the positioning holes.

As an alternative embodiment of the outer drum of the washing machine, at least three screw studs are arranged on an end of the outer drum. Each of the screw studs is configured to fix the outer drum to the housing of the washing machine by a bolt.

As an alternative embodiment of the outer drum of the washing machine, a plurality of guide reinforcing ribs are arranged on the end of the outer drum. Each of the guide reinforcing ribs is arranged around the screw stud corresponding to the guide reinforcing rib. Each of the guide reinforcing ribs is configured to reinforce structural strength of the screw studs and prevent the bolts from connecting with the screw studs in dislocation. A total number of the guide reinforcing ribs us matched with a total number of the screw studs.

As an alternative embodiment of the outer drum of the washing machine, a clamping groove for fixing a ventilation pipe is formed in the drum body of the outer drum. The clamping groove can clamp the ventilation pipe of a pressure switch of the washing machine, so as to effectively reduce assembling time, increase assembly efficiency, and also prevent the housing from abrading the ventilation pipe due to vibration of the housing in an operation state of the washing machine.

The present disclosure also proposes a washing machine having the outer drum provided in any one of embodiments of the present disclosure.

The present disclosure has beneficial effects described below.

(1) The present disclosure proposes the outer drum of the washing machine. The two opposite side walls of the outer drum of the washing machine are formed as non-circular surfaces to avoid collision with the side plates of the housing. Therefore, an internal space of the washing machine is sufficiently used, a diameter of the outer drum and washing capacity of the washing machine are increased, and a problem that the outer drum collides and interferes with the housing in an operation process of the washing machine is effectively avoided, without changing the housing of the washing machine.

(2) The reticular reinforcing ribs are arranged on the outer side wall and the outer bottom wall of the outer drum. Alternatively, the reticular reinforcing rib arranged on the outer side wall of the outer drum is formed by fixedly connecting radial ring reinforcing ribs perpendicular to an axis of the drum body with axial reinforcing ribs parallel to the axis of the drum body; and the reticular reinforcing rib arranged on the outer bottom wall of the outer drum is formed by fixedly connecting annular circumferential reinforcing ribs perpendicular to the axis of the drum body with radiation-shaped radial reinforcing ribs perpendicular to the axis of the drum body. The reticular reinforcing ribs improve structural strength of the entire drum body of the outer drum while saving the raw materials without increasing the wall thickness of the outer drum.

(3) The inner bottom wall of the outer drum is smooth arc surface matched with the rear flange of the inner drum in shape, which can reduce attachment of the dirt in the drum body of the outer drum, keep clean and sanitary, and also reasonably save the assembling space to increase the volume of the inner drum.

(4) At least two positioning holes are formed on the outer circumferential surface of the outer drum. Axis directions of the positioning holes are the same as that of the outer drum. Each of the positioning holes is penetrated by the positioning support rod so that the outer drum is fixed to the housing by the positioning support rod. Since the outer drum is firmly fixed in the washing machine by the positioning support rods in a transportation process of the washing machine, the outer drum cannot move up and down due to vibration, thereby effectively preventing the outer drum from colliding with components in the washing machine due to the vibration and improving reliability of the washing machine in the transportation process.

(5) A plurality of reinforcing ribs the number of which is matched with the number of the positioning holes are arranged on the outer circumferential surface of the outer drum. Each of the reinforcing ribs is arranged around the positioning hole corresponding to the reinforcing rib. The reinforcing ribs can effectively prevent the positioning support rods from impacting and damaging a force applied to the positioning holes when penetrating through the positioning hole to position the outer drum, and enhance the structural strength of the positioning holes.

(6) At least three screw studs are arranged on the end of the outer drum. The screw studs are configured to fix the outer drum to the housing of the washing machine by the bolts. Since the axis direction of the outer drum is positioned by the bolts in a carrying process of the washing machine, the outer drum does not move in an axial direction due to the vibration, thereby effectively preventing the outer drum from colliding with the components in the washing machine due to the vibration and contributing to improvement of reliability of the washing machine in the transportation process.

(7) The guide reinforcing ribs the number of which is matched with the number of the screw studs are arranged on the end of the outer drum. Each of the guide reinforcing ribs is arranged around the screw stud corresponding to the guide reinforcing rib. The guide reinforcing ribs not only can effectively prevent the bolts from connecting with the screw studs in dislocation and play a guiding role, but also can reinforce the structural strength of the screw studs.

(8) The clamping groove for fixing the ventilation pipe is formed in the drum body of the outer drum. A screw-free design is adopted to reduce assembling time, also effectively prevent the washing machine from abrading the ventilation pipe due to vibration in the operation state, and prolong service life of the ventilation pipe.

(9) The present disclosure also provides the washing machine having the outer drum as described in any one of above embodiments. The washing machine can have beneficial effects brought by the outer drum of the washing machine described in any one of above embodiments.

BRIEF DESCRIPTION OF DRAWINGS

Drawings to be used in description of embodiments of the present disclosure are briefly described below. Apparently, the drawings in the following description are only some embodiments of the present disclosure.

LIST OF REFERENCE NUMERALS

1', outer drum; 2', hanging spring; 3', housing; 4', shock absorber;

1, outer drum; 2, housing; 21, side plate; 3, positioning support rod; 4, clamping groove; 5, radial ring reinforcing rib; 6, axial reinforcing rib; 7, annular axial reinforcing rib; 8, radiation-shaped radial reinforcing rib; 9, first arc surface; 10, second arc surface; 11, outer side wall; 12, outer bottom wall; 13, inner bottom wall; 14, screw stud; 15, reinforcing rib; 151, annular reinforcing rib; 152, radial reinforcing rib; 153, closed ring rib; 16, bolt; 161, fixing support member; 162, fixing sleeve pipe; 1621, pull ring buckle; 163, gasket; 164, cushion pad; 17, guide reinforcing rib; 171, radial guide reinforcing rib; 1711, protruded structure; 1712, inclined surface; 172, closed guide ring rib; 18, first mounting hole; 19, second mounting hole; 20, straight edge; 91, first positioning hole; 92, second positioning hole; 121, condenser interface; 122, diversion groove.

DETAILED DESCRIPTION

Embodiments of the present disclosure are further described in detail with reference to drawings. Apparently, described embodiments are only some embodiments of the present disclosure, rather than all of embodiments. All other embodiments obtained by those skilled in the art without contributing creative work based on embodiments of the present disclosure belong to a protection scope of the present disclosure.

Embodiment 1

Figure 1:
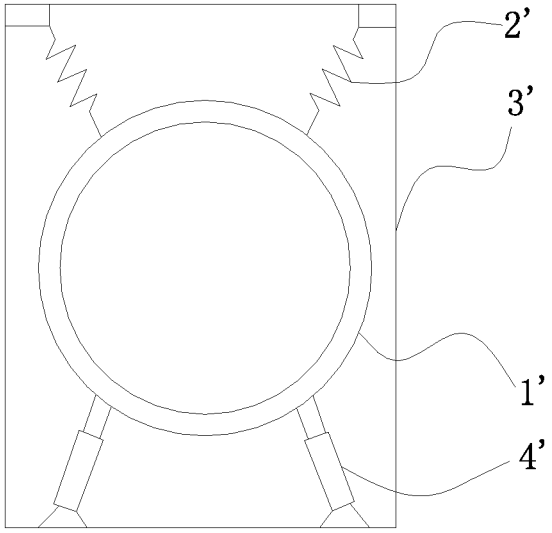
FIG. 1 is a sectional view illustrating a washing machine in a relevant technology.
Figure 2:
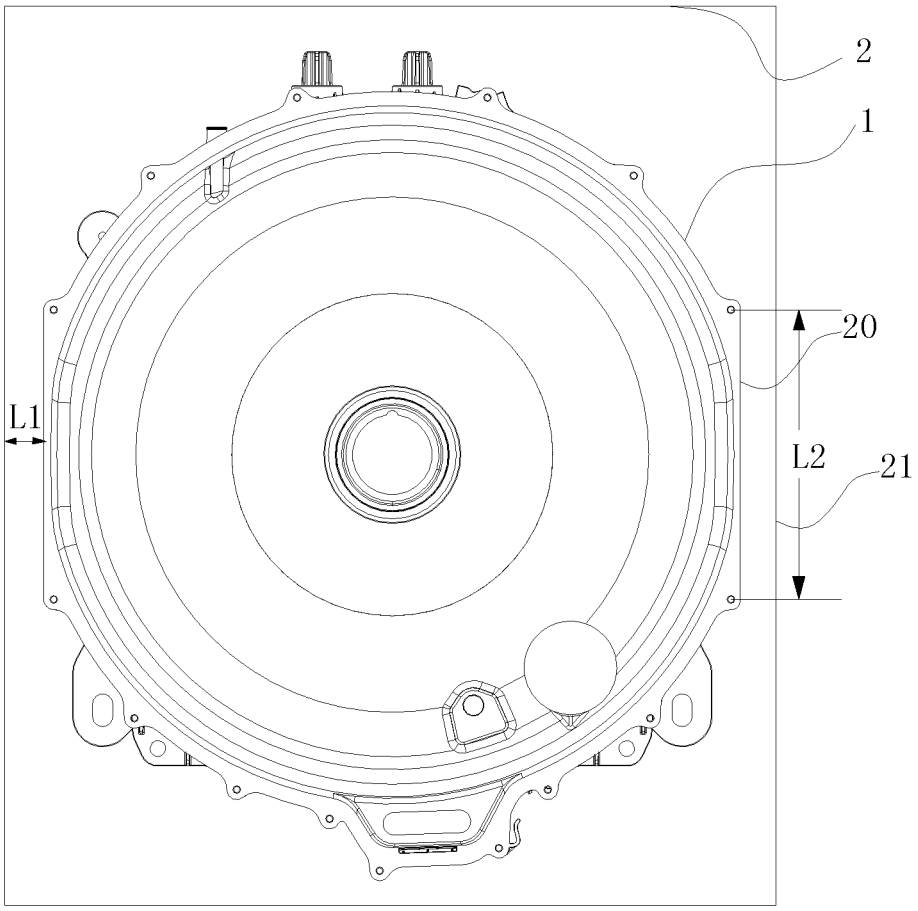
FIG. 2 is a structural schematic diagram illustrating an outer drum and a housing of a washing machine provided by embodiment 1 of the present disclosure.

FIG. 2 is a structural schematic diagram illustrating an outer drum of a washing machine provided by embodiment 1. As shown in FIG. 2, two opposite side walls of the outer drum of the washing machine 1 in the present embodiment are formed as non-circular surfaces to avoid collision with side plates 21 of a housing 2, i.e., drum walls of the outer drum of the washing machine 1 close to the side plates 21 on both sides of the housing 2 are formed as non-circular surfaces to avoid collision with the side plates 21 of the housing.

Alternatively, in the present embodiment, the non-circular surfaces may be flat surfaces which are straight edges 20 having a certain length. There is a certain reserved gap between the side plates 21 and the straight edges 20. Optionally, as shown in FIG. 2, a gap of 15 mm (i.e., L1 in FIG. 2) is reserved between the straight edges 20 and the side plates 21 of the housing 2 in the present embodiment. A length L2 of the straight edges 20 is 230 mm. The gap L1 reserved between the straight edges 20 and the side plates 21 of the housing 2 and the length L2 of the straight edges 20 can be designed according to conditions of a movement trajectory of the outer drum 1, as long as a requirement of preventing the outer drum 1 from colliding and interfering with the side plates 21 of the housing during vibration is satisfied.

Under a condition that the housing 2 of the washing machine and the reserved gap L1 are not changed, a diameter of the outer drum 1 is increased in order to make full use of an internal space of the washing machine; and a conclusion is drawn according to the movement trajectory of an inner drum of the washing machine and multiple tests as follows: the greater the diameter of the outer drum 1 is, the greater the length L2 of the straight edge 20 should be.

Other drum wall portions of the outer drum 1 except side walls close to the side plates 21 on both sides of the housing 2 are same as the drum wall of the outer drum of the washing machine in the relevant technology in shape, and are circular surfaces with a same curvature.

According to the outer drum of the washing machine provided by the present embodiment, the internal space of the washing machine is sufficiently used, the diameter of the outer drum and the washing capacity of the washing machine are increased, and the outer drum is effectively prevented from colliding and interfering with the housing in an operation process of the washing machine, without changing the housing of the washing machine.

Embodiment 2

Figure 3:
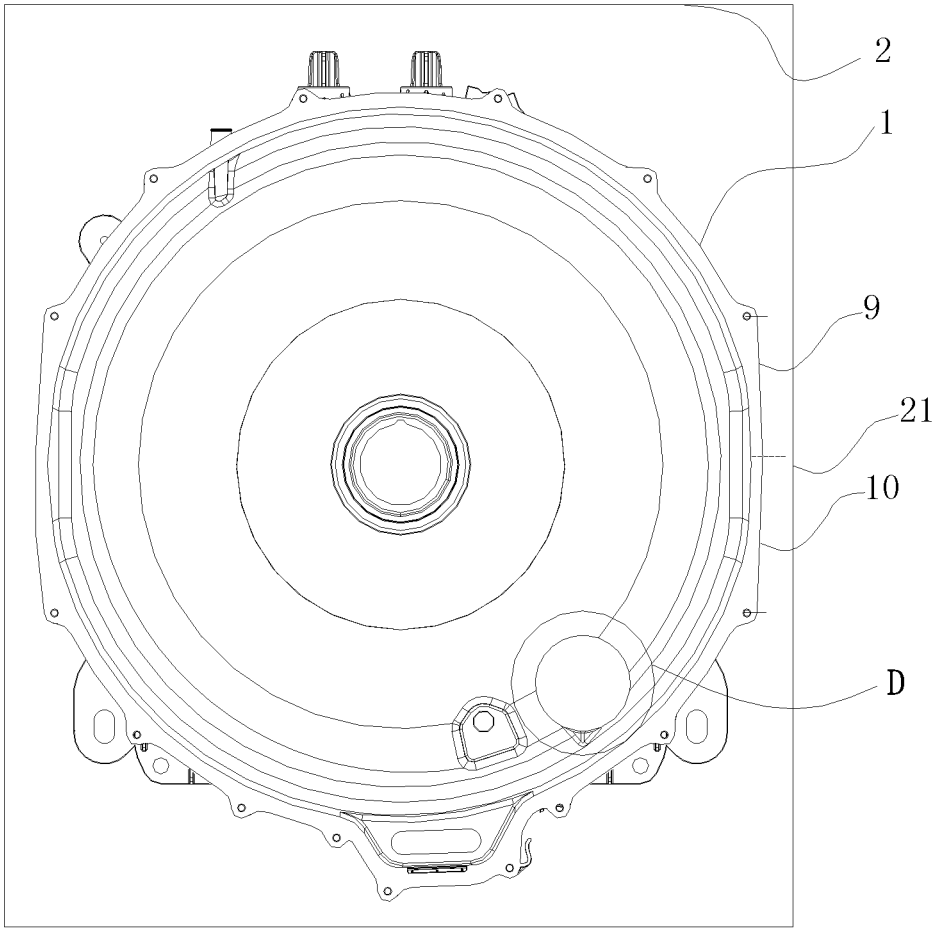
FIG. 3 is a structural schematic diagram illustrating an outer drum and a housing of a washing machine provided by embodiment 2 of the present disclosure.

FIG. 3 is a structural schematic diagram illustrating an outer drum of a washing machine provided by embodiment 2. As shown in FIG. 3, a difference between the structure of the outer drum of the washing machine of the present embodiment and that described in embodiment 1 is described below.

The two opposite side walls of the outer drum of the washing machine 1 are formed as non-circular surfaces. Optionally, the non-circular surfaces are curved surfaces formed by splicing arc curved surfaces with different curvatures. Optionally, In the present embodiment, the arc curved surfaces with different curvatures are arc surfaces protruding toward the side plates 21 of the housing 2.

In view of the reasons described below, the non-circular surfaces are designed in the above shape rather than the curved surfaces formed by splicing the arc surfaces having different curvatures and recessed toward a center of the outer drum 1. On one hand, the outer drum 1 is effectively prevented from colliding and interfering with the side plates 21 of the housing during vibration when the diameters of the outer drum 1 and the inner drum are increased. On the other hand, the outer drum 1 is effectively prevented from colliding and interfering with the inner drum during vibration when the diameters of the outer drum 1 and the inner drum are increased. Based on the above, the non-circular surfaces cannot be designed as the curved surfaces formed by splicing the arc surfaces having different curvatures and recessed toward the center of the outer drum 1, and can only be designed as the curved surfaces formed by splicing the arc surfaces having different curvatures and protruding toward the side plates 21 of the housing 2.

In the present embodiment, the non-circular surfaces can optionally be the curved surfaces formed by splicing two arc surfaces having different curvatures and protruding toward the side plates 21 of the housing 2. The two arc surfaces are respectively a first arc surface 9 (the arc surface between an upper short solid line and a middle short dotted line in FIG. 3) and a second arc surface 10 (the arc surface between a lower shot solid line and the middle short dotted line in FIG. 3) separated by a dotted line in FIG. 3. The curvatures of the two arc surfaces can be selected according to the conditions of the movement trajectory of the outer drum 1, as long as an effect of preventing the outer drum 1 from colliding and interfering with the side plates 21 of the housing during vibration is realized.

Structures of other drum wall portions of the outer drum 1 in the present embodiment are similar to or same as those of other drum wall portions of the outer drum 1 in embodiment 1, and therefore are not repeated herein.

Figure 4:
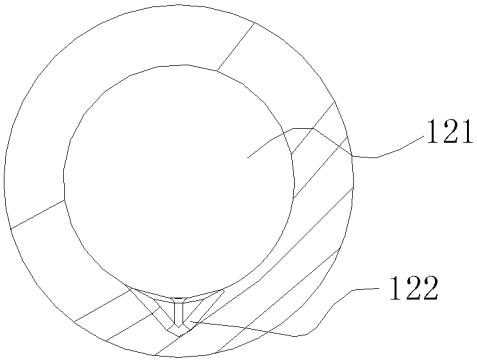
FIG. 4 is a local enlarged view of D position in FIG. 3.

Optionally, in order to improve a condensation effect of the washing machine (a clothes dryer or an integrated washing and drying machine) having the above outer drum of the washing machine 1, as shown in FIG. 3 and FIG. 4, a water-cooling condenser is further arranged on the washing machine. The water-cooling condenser includes a condenser interface 121 arranged at a bottom end of the outer drum 1. A V-shaped diversion groove 122 is formed at the condenser interface 121 to allow dried condensed water to flow out conveniently.

According to the outer drum of the washing machine provided by the present embodiment, the internal space of the washing machine is sufficiently used, the diameter of the outer drum and the washing capacity of the washing machine are increased, and the outer drum is effectively prevented from colliding and interfering with the housing in an operation process of the washing machine, without changing the housing of the washing machine.

Embodiment 3

Figure 5:
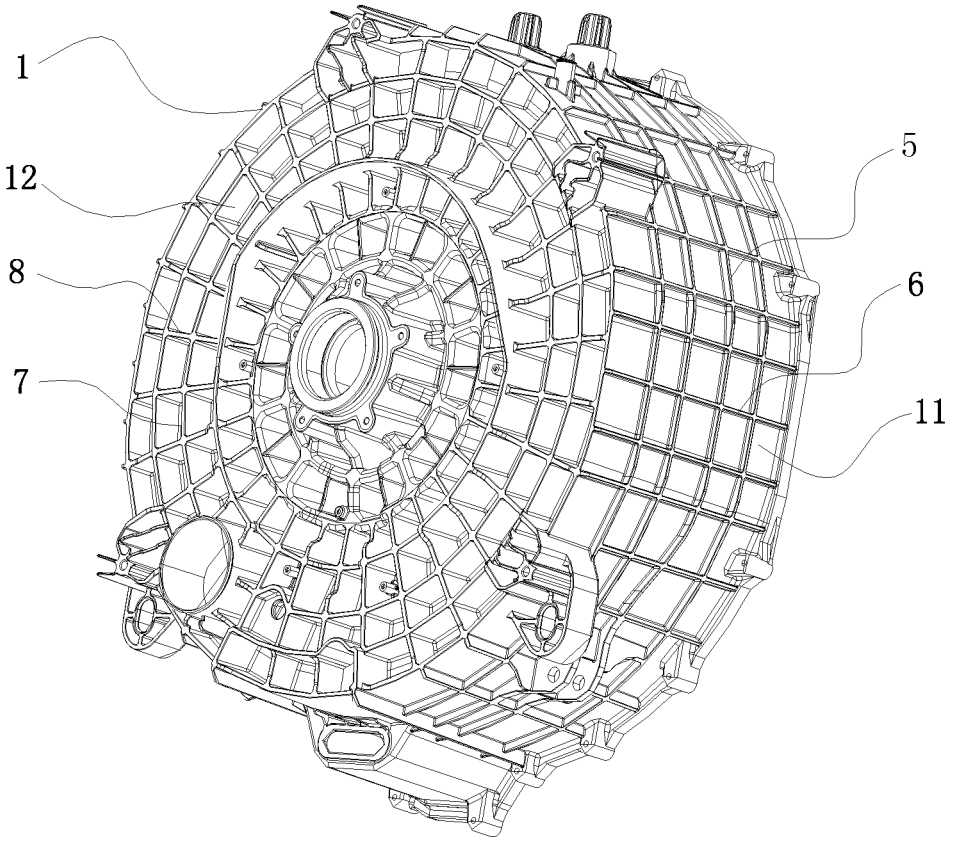
FIG. 5 is a structural schematic diagram illustrating an outer drum of a washing machine provided by embodiment 3 of the present disclosure.

FIG. 5 is a structural schematic diagram illustrating an outer drum of the washing machine provided by embodiment 3 of the present disclosure. As shown in FIG. 5, based on the structure (i.e., the drum walls close to the side plates on both sides of the housing 2 of the washing machine are formed as the flat surfaces to avoid collision with the side plates 21 of the housing) of the outer drum of the washing machine described in embodiment 1, reticular reinforcing ribs are arranged on an outer side wall 11 and an outer bottom wall 12 of the outer drum 1 in the present embodiment.

Optionally, in the present embodiment, each reticular reinforcing rib arranged on the outer side wall 11 of the outer drum 1 is formed by fixedly connecting a plurality of radial ring reinforcing ribs 5 perpendicular to an axis of the drum body with a plurality of axial reinforcing ribs 6 parallel to the axis of the drum body. The reticular reinforcing rib arranged on the outer bottom wall 12 of the outer drum 1 is formed by fixedly connecting a plurality of annular axial reinforcing ribs 7 perpendicular to the axis of the drum body with a plurality of radiation-shaped radial reinforcing ribs 8 parallel to the axis of the drum body. A spacing between two adjacent radial ring reinforcing ribs 5, a spacing between two adjacent axial reinforcing ribs 6, a spacing between two adjacent annular axial reinforcing ribs 7 and a spacing between two adjacent radiation-shaped radial reinforcing ribs 8 are designed in terms of production cost, structural strength and the like.

In the outer drum of the washing machine provided by the present embodiment, by arranging the reticular reinforcing ribs on the outer side wall 11 and the outer bottom wall 12 of the outer drum of the washing machine respectively, the structural strength of the entire drum body of the outer drum is improved while saving raw materials without increasing a wall thickness of the outer drum.

Embodiment 4

The inner bottom wall of the outer drum of the washing machine in a relevant technology generally adopts a flat bottom surface. However, a structure of flat bottom surface not only causes attachment of a large amount of dirt to the outer drum and inconvenience in cleaning, but also needs a certain reserved inner drum assembling space. If an area occupied by the assembling space is large, the volume of the inner drum is relatively small.

Figure 6:
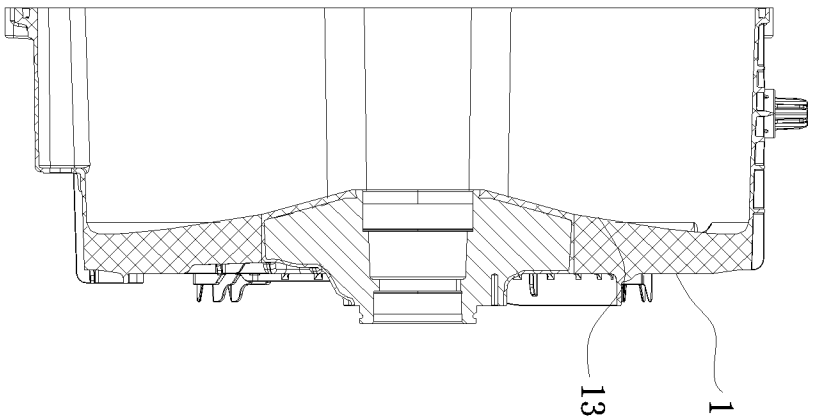
FIG. 6 is a structural schematic diagram illustrating an outer drum of a washing machine provided by embodiment 4 of the present disclosure.

In order to solve the above problems, embodiment 4 provides a novel structure of the outer drum of the washing machine. As shown in FIG. 6, an inner bottom wall 13 of the outer drum of the washing machine 1 in the present embodiment adopts a smooth arc surface recessed toward the bottom wall of the outer drum; and the smooth arc surface is matched with the rear flange of the inner drum in shape, i.e., the curvature of the smooth arc surface depends on the shape of the rear flange of the inner drum.

In the present embodiment, by forming the inner bottom wall of the outer drum of the washing machine as the recessed smooth arc surface structure, not only a normal rotating operation of the inner drum is ensured, but also attachment of dirt to the outer drum is effectively reduced, keeping clean and sanitary. Meanwhile, the assembling space is reasonably saved and the volume of the inner drum is increased.

Embodiment 5

Figure 7:
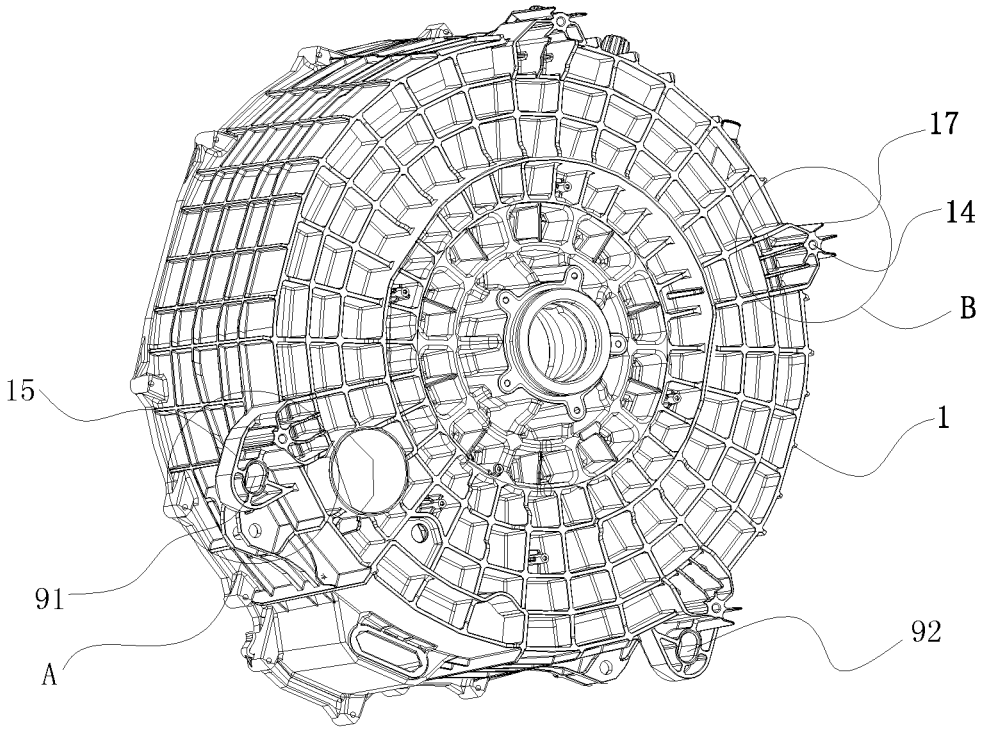
FIG. 7 is a structural schematic diagram illustrating an outer drum of a washing machine provided by embodiment 5 of the present disclosure.
Figure 8:
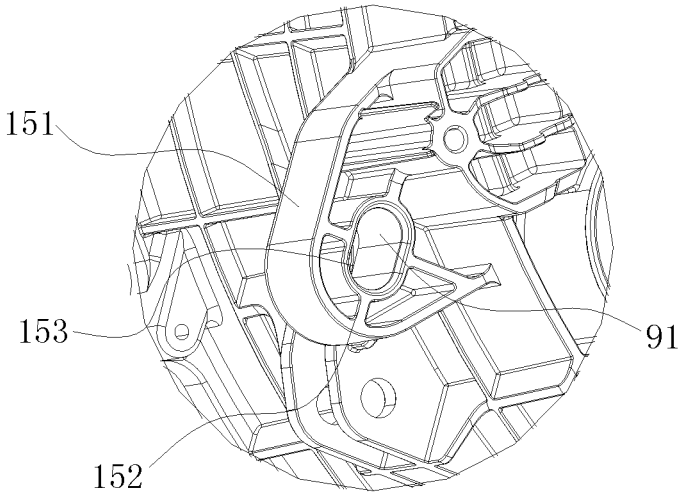
FIG. 8 is a local enlarged view of A position in FIG. 7.
Figure 9:
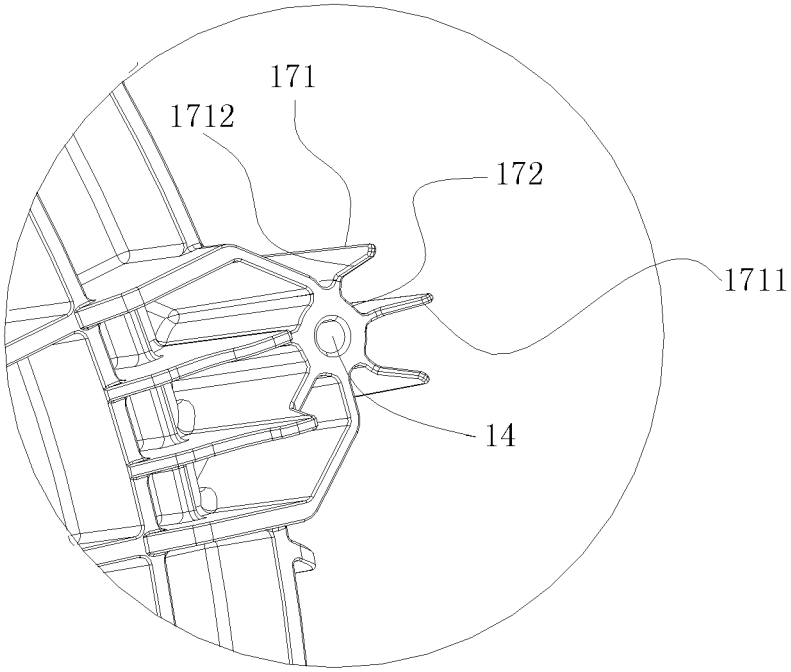
FIG. 9 is a local enlarged view of B position in FIG. 7.
Figure 10:
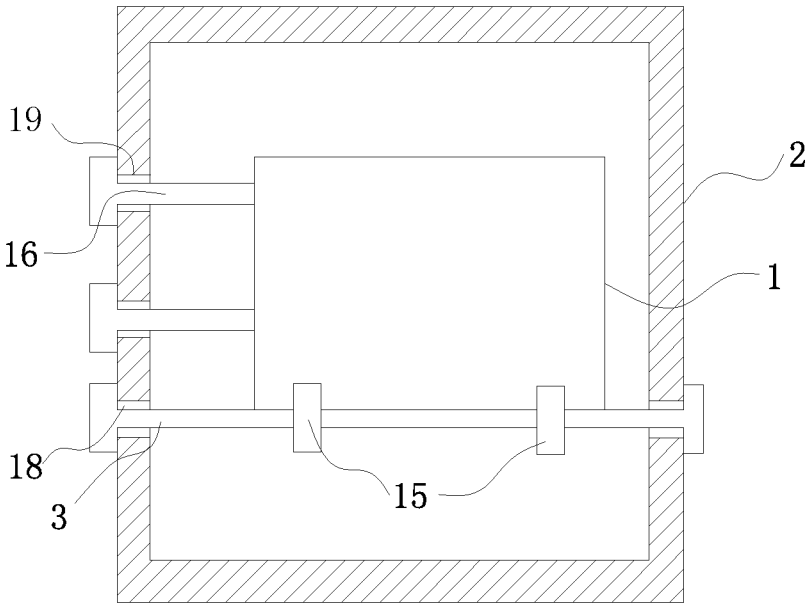
FIG. 10 is a structural schematic diagram illustrating a washing machine provided by embodiment 5 of the present disclosure.

FIG. 7 to FIG. 9 are structural schematic diagrams illustrating an outer drum of the washing machine provided by embodiment 5. FIG. 10 is a structural schematic diagram illustrating the washing machine of the present embodiment. As shown in FIG. 7 to FIG. 10, optionally, at least two positioning holes are formed on an outer circumferential surface of the outer drum of the washing machine 1 of the present disclosure. Axis directions of the positioning holes are the same as an axis direction of the outer drum 1. Each of positioning support rods 3 penetrates through one of the positioning holes so that the outer drum 1 is fixed to the housing 2 of the washing machine by the positioning support rods 3.

Optionally, in the present embodiment, two positioning holes (two positioning holes in a front end of the outer drum 1 not shown in FIG. 7) arranged in parallel are respectively formed in outer circumferential surfaces (a front flange and a rear flange of the outer drum 1) of the outer drum 1 close to a front end and a rear end of the outer drum. Positions of the positioning holes in the front end and the rear end are in one-to-one correspondence so as to form two groups of positioning holes (four positioning holes). A circumferential angle formed between the two positioning holes located in a same end is in a range of 60-110 degrees. Alternatively, the two groups of positioning holes are respectively a group of first positioning holes 91 and a group of second positioning holes 92. A positioning support rod 3 can be respectively penetrated in each of the group of first positioning holes 91 and the group of second positioning holes 92. Two groups of first mounting holes 18 corresponding to the two groups of positioning holes one by one are formed in the housing 2 of the washing machine. The positioning support rods 3 penetrate through the first mounting holes 18 and the positioning holes so as to firmly position the outer drum 1 on the housing 2 by the positioning support rods 3. Since the outer drum 1 is firmly fixed in the washing machine by the positioning support rods 3 in a transportation process of the washing machine, the outer drum 1 cannot move up and down due to vibration, thereby effectively preventing the outer drum 1 from colliding with components in the washing machine due to the vibration and improving reliability of the washing machine in the transportation process.

Optionally, in order to conveniently form the positioning holes in the outer drum 1 and effectively enhance the structural strength of the positioning holes, reinforcing ribs 15 are arranged on the outer circumferential surface of the outer drum 1. The number of reinforcing ribs 15 is matched with the number of the positioning holes. In the present embodiment, two reinforcing ribs 15 are respectively arranged on the outer circumferential surfaces of the outer drum 1 close to the front end and the rear end of the outer drum, i.e., two groups of reinforcing ribs 15 (including four reinforcing ribs 15) exist. Each of the first positioning holes 91 is formed in one reinforcing rib 15; and each of the second positioning holes 92 is formed in one reinforcing rib 15. As shown in FIG. 8, each of the reinforcing ribs 15 includes an annular reinforcing rib 151, a plurality of radial reinforcing ribs 152 and a circle of closed ring ribs 153. The annular reinforcing rib 151 and the plurality of radial reinforcing rib 152 are arranged perpendicular to a side wall of the outer drum 1. The plurality of radial reinforcing ribs 152 are radially arranged in a space surrounded by the annular reinforcing rib 151 and the side wall of the outer drum 1. A first end of each of the radial reinforcing ribs 152 is fixedly connected with the annular reinforcing rib 151; and a second end is fixedly connected with the closed ring ribs 153 for forming the positioning holes. The reinforcing ribs 15 effectively prevents the positioning support rods 3 from impacting and damaging a force applied to the positioning holes when penetrating through the positioning hole to position the outer drum 1, thereby enhancing the structural strength of the positioning holes.

Optionally, as shown in FIG. 7 to FIG. 10, in order to effectively prevent the outer drum 1 from moving along the axis direction due to vibration, at least three screw studs 14 are arranged on a rear end of the outer drum of the washing machine 1 of the present disclosure. The screw studs 14 are configured to fix the outer drum 1 to the housing 2 of the washing machine by bolts 16.

Optionally, in the present embodiment, four screw studs 14 are uniformly distributed on an end of a drum bottom of the outer drum of the washing machine 1. The four screw studs 14 are arranged symmetrically, where two of the screw studs 14 are arranged above the drum bottom, and the other two screw studs 14 are arranged below the drum bottom. The two screw studs 14 located below the drum bottom are respectively arranged close to the first positioning holes 91 and the second positioning holes 92. The second mounting holes 19 corresponding to the four screw studs 14 one by one are formed in the housing 2 of the washing machine; and the four screw studs 14 are used for threaded connection with the bolts 16 penetrated in the second mounting holes 19. Each of the bolts 16 can penetrate through one second mounting hole 19 and can be in threaded connection with one screw stud 14, thereby positioning the axis direction of the outer drum 1 by the bolts 16. Since the axis direction of the outer drum 1 is positioned by the bolts 16 in the transportation process of the washing machine, the outer drum 1 cannot move along the axial direction due to the vibration, thereby effectively preventing the outer drum 1 from colliding with the components in the washing machine due to the vibration and benefiting improvement of the reliability of the washing machine in the transportation process.

Optionally, in order to conveniently arrange the screw studs 14 on the outer drum 1 and effectively enhance the structural strength of the screw studs 4, guide reinforcing ribs 17 are arranged on the end of the drum bottom of the outer drum 1. The number of guide reinforcing ribs 17 is matched with the number of the screw studs 14. In the present embodiment, four guide reinforcing ribs 17 are arranged on the end of the drum bottom of the outer drum 1. Each of the guide reinforcing ribs 17 is arranged around the screw stud 14 corresponding to the guide reinforcing rib 17.

Optionally, in the present embodiment, as shown in FIG. 9, each of the guide reinforcing ribs 17 includes a plurality of radial guide reinforcing ribs 171 and a circle of closed guide ring ribs 172. The plurality of radial guide reinforcing ribs 171 are radially arranged at and perpendicular to the drum bottom of the outer drum 1. First ends of the radial guide reinforcing ribs 171 are fixedly connected with the closed guide ring ribs 172 for forming the screw studs 14; second ends of the radial guide reinforcing ribs 171 have protruded structures 1711 protruding from upper end surfaces of the screw studs 14; and inner sides of the protruded structures 1711 are inclined surfaces 1712 for guiding when the bolts 16 are inserted into the screw studs 14. Alternatively, a distance between bottom ends of the above inclined surfaces 1712 and center lines of the screw studs 14 is smaller than a distance between top ends of the inclined surfaces 1712 and the center lines of the screw studs 14, i.e., the inclined surfaces 1712 of the protruded structures 1711 of all the radial guide reinforcing ribs 171 jointly form a conical cavity wide at the top and narrow at the bottom; and the conical cavity can be used for limiting a fixing support member 161 of a packaging bolt component. Therefore, the guide reinforcing ribs 17 with the above structure not only can effectively prevent the bolts 16 from connecting with the screw studs 14 in dislocation and play a guiding role, but also can enhance the structural strength of the screw studs 14.

Figure 11:
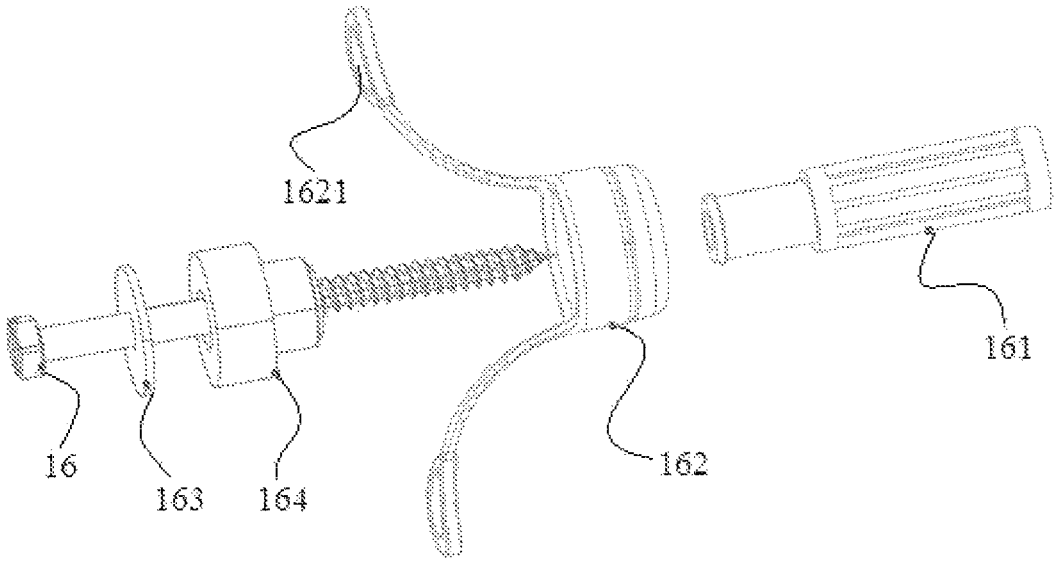
FIG. 11 is an exploded view illustrating an assembly structure of a bolt and a packaging bolt component provided by embodiment 5 of the present disclosure.
Figure 12:
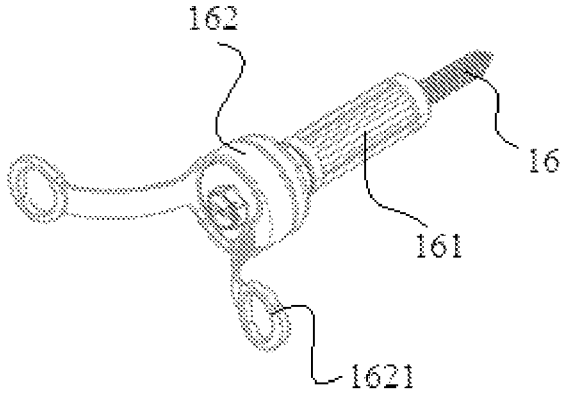
FIG. 12 is an overall diagram illustrating an assembly structure of a bolt and a packaging bolt component provided by embodiment 5 of the present disclosure.

In order to assemble the bolts 16 more conveniently and rapidly, the bolts 16 can be assembled by the packaging bolt component. As shown in FIG. 11 and FIG. 12, the packaging bolt component includes the fixing support member 161, a fixing sleeve pipe 162, a gasket 163 and a cushion pad 164. The gasket 163, the cushion pad 164, the fixing sleeve pipe 162 and the fixing support member 161 are fixed by the bolts 16. In a process of assembling the packaging bolt component by the bolts 16, the bolts 16 successively penetrate through the gasket 163, the cushion pad 164, the fixing sleeve pipe 162, the second mounting holes 19 in the housing 2 and the fixing support member 161 and are in threaded connection with the screw studs 14. The gasket 163, the cushion pad 164 and the fixing sleeve pipe 162 are located outside the housing 2 of the washing machine; the fixing support member 161 is located in a space between the housing 2 and the outer drum 1; and an end of the fixing support member 161 is at least partially limited in the conical cavity of the guide reinforcing ribs 17 arranged on the outer drum 1, thereby firmly fixing the outer drum 1 in a radial direction, e.g., in the axial direction.

Optionally, in order to disassemble the assembled bolts 16 conveniently, two symmetrically arranged pull ring buckles 1621 are disposed on the fixing sleeve pipe 162. The bolts 16 and the packaging bolt component can be detached conveniently and rapidly by pulling the two pull ring buckles 1621, thereby saving disassembling time and increasing disassembly efficiency.

The outer drum 1 in the present embodiment is not limited to be provided with two groups of positioning holes, and can also be provided with three groups of positioning holes; the quantity of the reinforcing ribs 15 matched with the positioning holes should also be three groups; centers of circles of the three positioning holes located in the same end of the outer drum 1 form a stable triangle; three groups of first mounting holes 18 corresponding to the three groups of positioning holes one by one are formed in the housing 2 of the washing machine; and the outer drum 1 can also be positioned in the radial direction by that the three positioning support rods 3 penetrate through the three groups of first mounting holes 18 and the three groups of positioning holes.

The outer drum 1 in the present embodiment is not limited to be provided with four screw studs 14, and can also be provided with three screw studs 14. The number of the guide reinforcing ribs 17 which is matched with that of the screw studs 14 should also be three. Centers of circles of the three screw studs 14 form a stable triangle. The second mounting holes 19 corresponding to the three screw studs 14 one by one are formed in the housing 2 of the washing machine. The outer drum 1 can also be positioned in the axial direction by that the three bolts 16 penetrate through the three second mounting holes 19 and the three screw studs 14.

Embodiment 6

Figure 13:
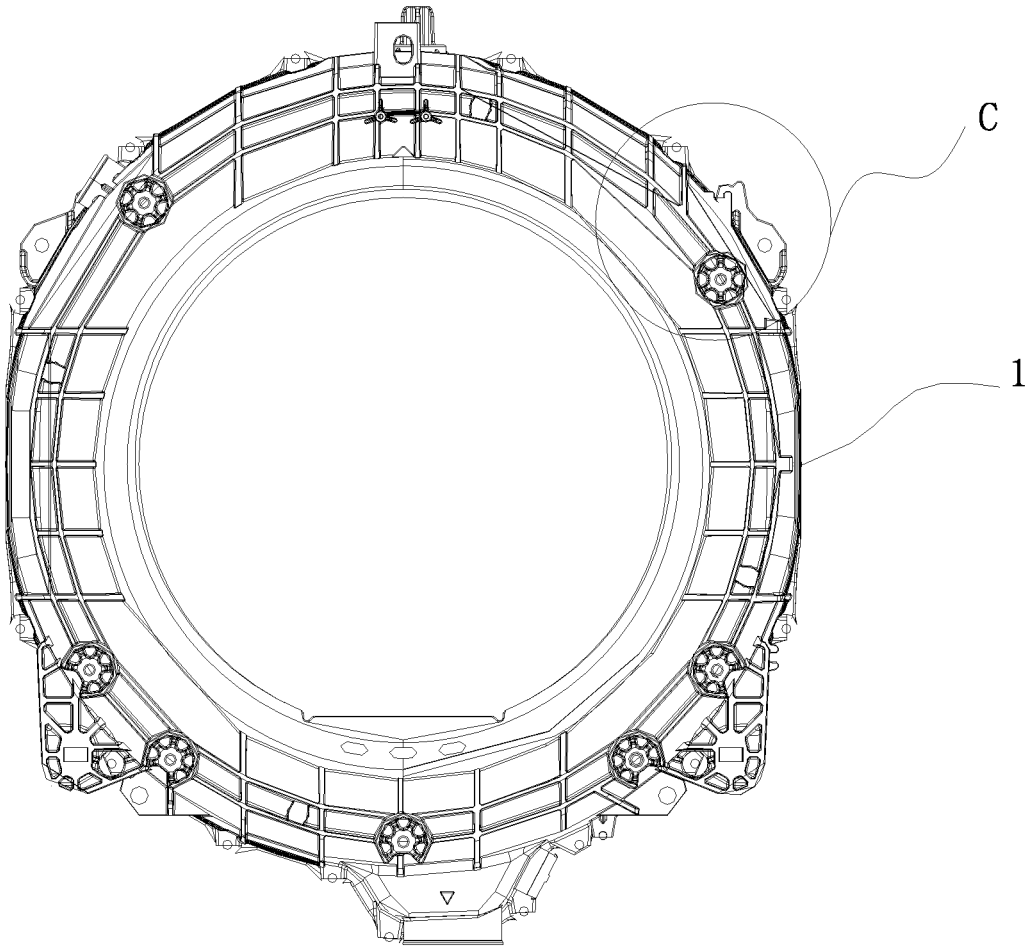
FIG. 13 is a structural diagram illustrating an outer drum of a washing machine provided by embodiment 6 of the present disclosure.
Figure 14:
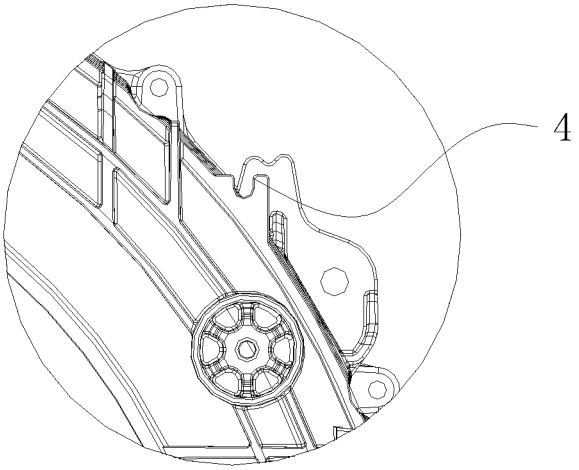
FIG. 14 is a local enlarged view of C position in FIG. 13.

FIG. 13 and FIG. 14 are structural schematic diagrams illustrating an outer drum of the washing machine provided by embodiment 6. As shown in FIG. 13 and FIG. 14, a clamping groove 4 for fixing a ventilation pipe is formed in a drum body of the outer drum of the washing machine 1 in the present embodiment. In the present embodiment, the clamping groove 4 can optionally be a clamping hook. An opening size of the clamping hook is matched with the diameter of the ventilation pipe. The clamping groove 4 of the present embodiment adopts a screw-free design to reduce assembling time, effectively prevent the washing machine from abrading the ventilation pipe due to vibration in the operation state, and prolong service life of the ventilation pipe.

In addition, the outer drum of the washing machine 1 is supported by at least three shock absorbers. Optionally, in the present embodiment, four symmetrically arranged shock absorbers are used for supporting and stabilizing the outer drum 1. Optionally, every two shock absorbers are respectively arranged on both sides of the outer drum 1; one shock absorber is arranged in relative front and back of each side, respectively; thus, the drum body of the outer drum 1 is stressed uniformly under a supporting effect of the four shock absorbers, thereby greatly reducing a vibration amplitude of the outer drum 1 and improving vibration stability of the outer drum 1.

Embodiment 7

The present embodiment 7 proposes a washing machine having the outer drum as described in any one of embodiments 1 to 6. The washing machine may have beneficial effects brought by the outer drum of the washing machine provided by any one of above embodiments.

It should be noted that those skilled in the art can understand that the present disclosure is not limited to specific embodiments described herein and can make various changes, readjustments and substitutions without departing from a protection scope of the present disclosure. Thus, although the present disclosure is described in detail by above embodiments, the present disclosure is not just limited to above embodiments.

INDUSTRIAL APPLICABILITY

According to the outer drum of the washing machine provided by the present embodiment, the internal space of the washing machine is sufficiently used, the diameter of the outer drum and the washing capacity of the washing machine are increased, and the outer drum is effectively prevented from colliding and interfering with the housing in an operation process of the washing machine, without changing the housing of the washing machine.

What is claimed is:

1. An outer drum of a washing machine comprising:

two opposite side walls formed as non-circular surfaces to avoid collision with side plates of a housing of the washing machine;

at least two positioning holes formed on an outer circumferential surface of the outer drum, axis directions of the at least two positioning holes being the same as an axis direction of the outer drum, each of the at least two positioning holes being penetrated by a positioning support rod so that the outer drum is fixed to the housing by the positioning support rod;

at least three screw studs arranged on an end of the outer drum, each of the at least three screw studs configured to fix the outer drum to the housing of the washing machine by a bolt and a plurality of reinforcing ribs arranged on the outer circumferential surface of the outer drum, each of the plurality of reinforcing ribs arranged around one of the at least two positioning holes corresponding to each of the plurality of reinforcing ribs;

wherein a total number of the plurality of reinforcing ribs corresponds to a total number of the at least two positioning holes;

wherein each of the plurality of reinforcing ribs comprises an annular reinforcing rib, a plurality of radial reinforcing ribs, and a closed ring rib for forming a respective one of the at least two positioning holes, the annular reinforcing rib and the plurality of radial reinforcing ribs arranged perpendicular to the side walls of the outer drum, the plurality of radial reinforcing ribs radially arranged in a space surrounded by the annular reinforcing rib and the side walls of the outer drum;

wherein each of the at least two positioning holes is arranged adjacent to one of the at least three screw studs, and the one of the at least three screw studs is arranged in the space surrounded by the annular reinforcing rib and the side walls of the outer drum; and wherein an axis direction of the each of the at least two positioning holes is the same as an axis direction of the one of the at least three screw studs.

2. The outer drum of the washing machine according to claim 1, wherein the non-circular surfaces are flat surfaces.

3. The outer drum of the washing machine according to claim 1, wherein a plurality of reticular reinforcing ribs are arranged on an outer side wall and an outer bottom wall of the outer drum.

4. The outer drum of the washing machine according to claim 1, wherein an inner bottom wall of the outer drum is a smooth arc surface matched with a rear flange of an inner drum in shape.

5. The outer drum of the washing machine according to claim 1, wherein a plurality of guide reinforcing ribs are arranged on the end of the outer drum, and each of the guide reinforcing ribs is arranged around the screw stud corresponding to the guide reinforcing rib, wherein each of the guide reinforcing ribs is configured to reinforce structural strength of the screw studs and prevent the bolt from connecting with the screw studs in dislocation, wherein a total number of guide reinforcing ribs is matched with a total number of the screw studs.

6. The outer drum of the washing machine according to claim 1, wherein a clamping groove for fixing a ventilation pipe is formed in a drum body of the outer drum.

7. The outer drum of the washing machine according to claim 1, wherein the non-circular surfaces are curved surfaces formed by splicing arc curved surfaces with different curvatures.

* * * * *